United States Patent [19]

Davis

[11] 4,072,877

[45] Feb. 7, 1978

[54] TRAVELLING WAVE TUBES

[75] Inventor: Peter Robert Davis, Chelmsford, England

[73] Assignee: English Electric Valve Co., Ltd., England

[21] Appl. No.: 710,130

[22] Filed: July 30, 1976

[51] Int. Cl.[2] ..... H01J 25/34

[52] U.S. Cl. ..... 315/3.5; 315/5.35; 315/39.3

[58] Field of Search ..... 315/3.5, 5.35, 39.3

[56] References Cited

U.S. PATENT DOCUMENTS

| | | | |
|---|---|---|---|
| 2,225,447 | 12/1940 | Haeff et al. | 315/5.35 X |
| 3,324,339 | 6/1967 | Winslow et al. | 315/5.35 X |
| 3,366,904 | 1/1968 | Schmidt | 315/5.35 X |
| 3,562,683 | 2/1971 | DeSantis et al. | 315/5.35 |
| 3,885,192 | 5/1975 | Esterson et al. | 315/5.35 |
| 3,958,147 | 5/1976 | Triplett | 315/5.35 |
| 3,971,965 | 7/1976 | Baker et al. | 315/5.35 |

*Primary Examiner*—Saxfield Chatmon, Jr.
*Attorney, Agent, or Firm*—Diller, Brown, Ramik & Wight

[57] ABSTRACT

A travelling wave tube of the kind having clover leaf cavities is provided with a periodic permanent magnetic structure, in which the magnetic material is located within noses projecting into the cavity space. A barrier between the magnetic material and the cavity space defines an evacuated envelope. Because the magnetic material is within the volume swept out by the cavity dimensions, it is positioned very close to the electron beam path.

8 Claims, 6 Drawing Figures

TRAVELLING WAVE TUBES

This invention relates to travelling wave tubes and in particular is concerned with the provision of a periodic permanent magnetic focussing structure for a travelling wave tube which is coupled for the fundamental mode of operation. As is known, travelling wave tubes are used to produce amplification of very high frequency electrical signals with little distortion, and this is achieved by coupling a low power high frequency signal onto an electron beam so as to produce a velocity modulation of the electrons. Because of the mutual repulsion of the negative electrons a magnetic focussing field is used to prevent the electron beam spreading. Although the magnetic field has in the past been provided by an electro-magnet surrounding the travelling wave tube, it is increasingly desirable for it to be provided by a permanent magnet arrangement which produces a periodic magnetic field, as this avoids the need to provide the large electric currents needed to energise the electro-magnets used previously. The present invention seeks to provide an improved travelling wave tube including a permanent magnet structure.

According to this invention a travelling wave tube includes a sequence of clover-leaf cavities coupled together for the fundamental mode of operation by coupling plates each plate having a central aperture through which passes the electron beam path and each clover-leaf cavity having permanent magnetic material between the radial extensions thereof in order to provide magnetic focussing for the electron beam.

The interior of the cavities are evacuated for normal operation to permit the electron beam to travel along the travelling wave tube, and preferably the permanent magnetic material is siturated outside the evacuated envelope of the travelling wave tube.

A clover leaf cavity may be regarded as formed by a number of radial noses projecting into a cylindrical cavity, the radial noses being separated by radial extensions of the cavity. Preferably the noses comprise the permanent magnetic material, a barrier material being situated between the permanent magnetic material and the interior of the cavity to define the evacuated envelope. Preferably the barrier material is copper which is hermetically sealed to the coupling plates on each side of each cavity.

Some or all of said coupling plates are composed of ferromagnetic material.

In order to produce the required periodic megnetic field the magnetic material located in the nose portions is provided with a north and south pole aligned with the longitudinal axis of the travelling wave tube. Every nose portion may contain magnetic material, but this is not essential.

Figure 1:
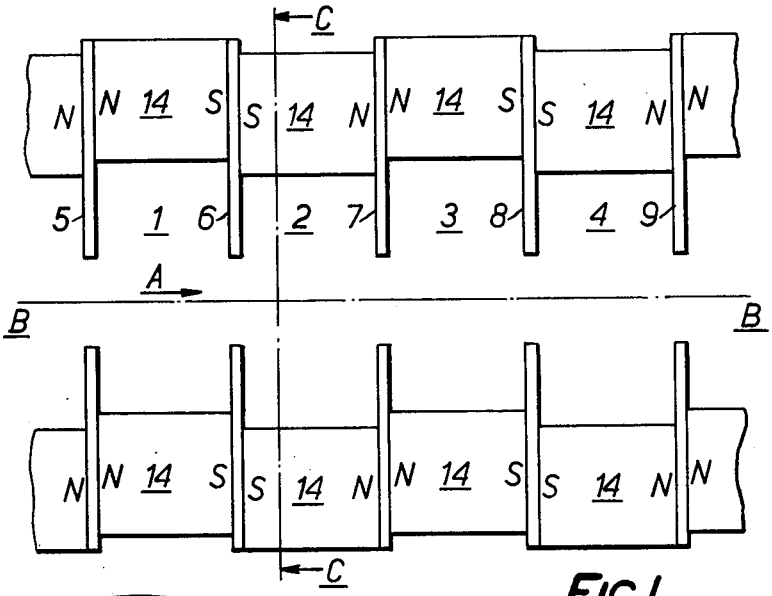
Figure 2:
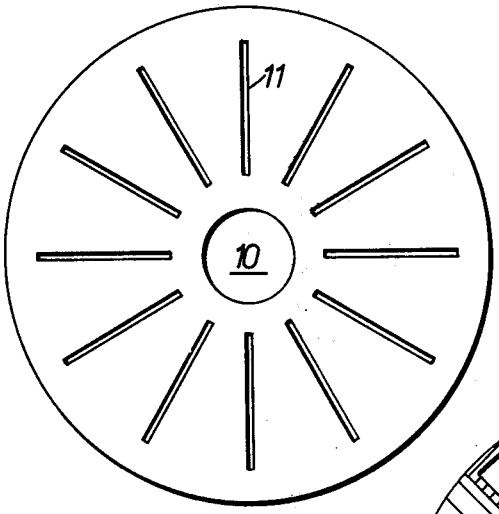
Figure 3:
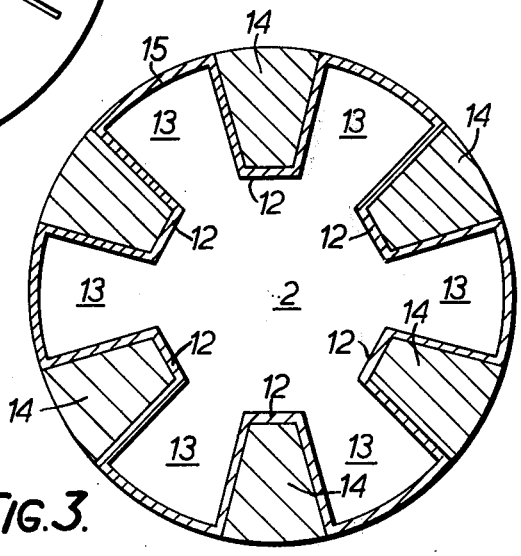
Figure 4:
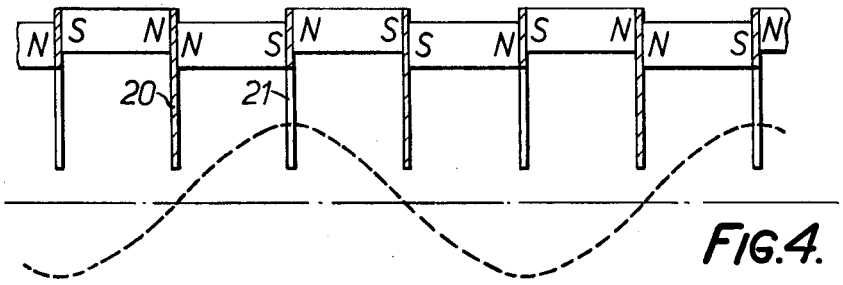
Figure 5:
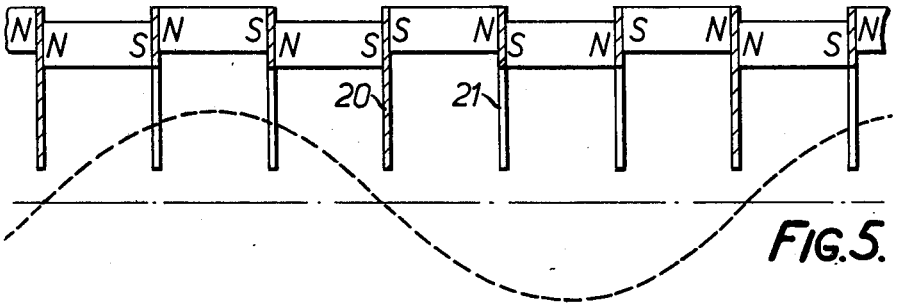
Figure 6:
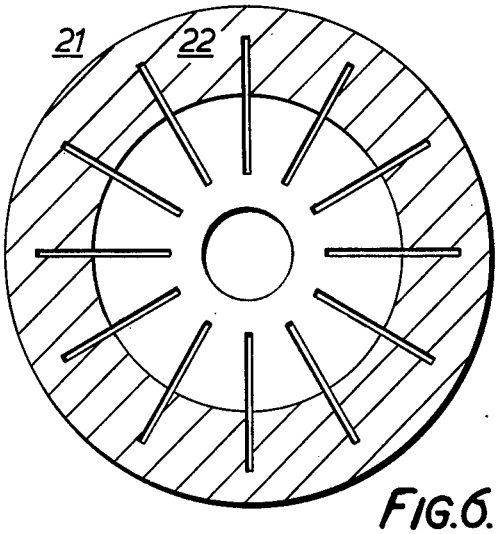

The invention is further described, by way of example, with reference to the accompanying drawings in which:

FIG. 1 shows a sectional view of part of the periodic permanent magnetic focussing structure of a traveling wave tube in accordance with the present invention, FIG. 2 shows a view of a coupling plate which is positioned between a pair of cavities shown in FIG. 1, FIG. 3 shows a sectional view through one of the cavities along line CC shown in FIG. 1, FIGS. 4 and 5 shows modifications and extensions to the travelling wave tube of FIG. 1, and FIG. 6 illustrates a detail of a coupling plate shown in FIGS. 4 and 5.

Referring to FIG. 1, there is shown therein part of a travelling wave tube. Only a portion of the magnetic focussing structure and slow wave structure is shown since the electron gun and the collector arrangements are quite conventional and form no part of the invention. In practice an electron gun would be situated to the left of the drawing on the centre line BB, and produces a beam of electrons which travel along the center line in the direction of the arrow A to the collector situated at the right-hand side of the drawing. As is known, the electron beam is made to interact with high frequency signals introduced into the slow wave structure, and a magnetic field is used to prevent the electron beam spreading and to confine it to the region of the center line BB, both to ensure that a large proportion of the electron beam reaches the collector, and to reduce the effect of the electron beam striking the body of the slow wave structure itself, as this latter effect can give rise to overheating of the slow wave structure. Travelling wave tubes to which the invention relates may have an electron beam energy of the order of 1/2 MW, and even when the interception of th electron beam with the body of the slow wave structure is kept to a minimum, steps have to be taken to keep it cool.

The slow wave structure shown in FIG. 1 consists of four cavities 1, 2, 3, 4 each bounded by a cavity wall 5, 6, 7, 8, 9 and it is to be understood that the structure extends both to the left and right and includes many more cavities than those illustrated. In particular cavities (not shown) at each end of the slow wave structure include means for introducing the high frequency input signal (possibly of the order of gigahertz) and for allowing the amplified signal to be taken off respectively.

Each cavity wall 5 to 9 consists of a thin soft iron plate and one of these is illustrated in FIG. 2. It is provided with a central circular aperture 10 through which, in operation, the electron beam passes and also with twelve radial shots 11 which provide the coupling between adjacent cavities. A section through cavity 2 taken on the line CC is shown in simplified diagrammatic fashion in FIG. 3. The cavity 2 is of what is known as the clover leaf kind, that is to say a number of noses 12 (in this case six) project into the cavity to produce in section a space resembling a six-leaf "clover." This terminology derives from early travelling wave tubes of this kind having only four noses, the cavity section thus being genuinely likened to a four-leaf clover. The radial extensions 13 of the cavity between each pair of adjacent noses 12 produce a radial component of the magnetic component of the electromagnetic wave excited in the cavity, and these radial components of the magnetic field couple with adjacent cavities 1 and 3 via the slots 11. Successive cavities are angularly offset from each preceding cavity by 30°, so that, with reference to FIG. 3 the positions of the noses 12 and radial extensions 13 would be interchanged for cavities 1 and 3 as compared with the cavity 2 which is illustrated.

The electron beam which passes along the center line BB from left to right (in FIG. 1) is confined to an axial path by means of a periodic permanent magnetic field produced by permanent magnets 14 poled in alternating succession as shown and which are located in the noses 12. A thin strip 15 of copper separates the magnets from the interior of the cavities, and each copper strip 15 is brazed at each side to the adjacent cavity wall so as to form a hermetically sealed envelope enclosing the cavities. This is necessary since the envelope is evacuated during manufacture — the cathode and collector are of course also situated within the evacuated region.

The magnets 14 can be inserted into the recesses formed by the copper strip 15 and the cavity walls e.g. 6 and 7 after the slow wave structure has been evacuated and "baked" at a high temperature during manufacture to expel residual gases. Because of outgassing problems of the magnets, and because their magnetic properties would be impaired or destroyed during the high temperature bake and because it is a periodic structure it is impractical to magnetize the magnets in position, it is considered a practical necessity (at least with present day magnetic materials) to locate the magnets outside the evacuated envelope and to mount then in position when all high temperature processing during manufacture has been completed.

In order to place as large a magnet 14 as possible in each nose 12 its shape should be fairly accurately tailored to the profile of the recess, and since the most suitable magnet materials, e.g. those known as the Alnico 8 series, or Samarium-Cobalt, are difficult to machine, it is preferable to cast the individual magnets to the required shape.

By placing the magnets within the total volume occupied by the slow wave structure, they can be placed much closer to the electron beam than is the case with previously known travelling wave tubes in which the periodic permanent magnet arrangement is situated outside a relatively smooth cylindrical surface surrounding the slow wave structure. This means that fewer and lighter magnets are required resulting in a travelling wave tube of reduced weight. Furthermore, since the magnets are positioned within the slow wave structure itself, and not external to it, the overall diameter of the travelling wave tube is kept to a minimum. In accordance with the present invention, however, it is not essential that the individual magnets located around a particular cavity are physically independent, and if desired the magnets can be linked by thin magnets external to the ends of the radial extensions 13.

In FIG. 1, all of the cavity walls 5 to 9 are composed of soft-iron and act as magnetic pole-pieces extending the magnetic field to the electron beam path. With this configuration one half of the magnetic period of the periodic permanent magnetic field is equal to the axial length of the cavity but this is not necessarily the best arrangement.

FIGS. 4 and 5 illustrate alternative arrangements in which the magnetic half period corresponds to $n$ cavities where $n$ is 2 and 3 respectively. Using this notation, FIG. 1 illustrates the case for $n = 1$. Only the upper half of the slow wave structure is shown, together with the corresponding magnetic field variations which are indicated in broken line.

Each magnetic half period is bounded by a coupling plate 20 made wholly of soft-iron as before, but the intermediate coupling plates 21 are composite plates consisting of an outer annular ring 22 of soft-iron and a central apertured disc of copper attached by brazing so as to be in good thermal and electrical contact therewith. The outer ring 22 provides the necessary magnetic coupling between adjacent magnets — this is important since adjacent magnets are not in line, but displaced sideways from one another. The copper discs complete the walls of the cavities. Each copper disc has an outer circumference corresponding to the circle on which the ends of the noses 12 approximately lie, and each composite coupling plate is slotted in a manner similar to that in which the wholly iron plates are slotted in order to maintain the electrical properties of the slow wave structure.

To give typical figures, by way of example, for $n = 1$ using ferrite magnets a peak magnetic field of about 850 gauss can be produced in a travelling wave tube dimensioned for operation at S-band frequencies (e.g. 3 gigahertz). For $n = 2$, the peak field is of the order of 1000 gauss. Although the amount of magnetic material that can be accommodated within the noses of the cavities is limited by the size of the recesses, the magnets are more effective since they are relatively close to the electron beam path and since the leakage paths are reduced.

The best value of $n$ depends on a number of factors, for example, on the electron beam energy and density, the peak magnetic field strengths, and on the frequency band at which the travelling wave tube is to be used; but in general it is expected that a satisfactory value of $n$ will be found in the range of 1 to 3 inclusive.

I claim:

1. A traveling wave tube including a sequence of clover-leaf cavities coupled together for the fundamental mode of operation by coupling plates, each plate having a central aperture through which passes the electron beam path and each clover-leaf cavity having outward radial extensions having permanent magnets between the radial outward extensions thereof in order to provide magnetic focussing for the electron beam.

2. A travelling wave tube as claimed in claim 1 and wherein the permanent magnets are situated outside the evacuated envelope of the travelling wave tube.

3. A travelling wave tube as claimed in claim 2 and wherein radial noses projecting into the clover-leaf cavities comprise the permanent magnets, a barrier material being situated between the permanent magnets and the interior of the cavity to define the evacuated envelope.

4. A travelling wave tube as claimed in claim 3 and wherein the barrier material is copper which is hermetically sealed to the coupling plates on each side of each cavity.

5. A travelling wave tube as claimed in claim 3 and wherein every nose contains permanent magnet.

6. An improved travelling wave tube structure employing periodic permanent magnet focussing, comprising in combination:

an evacuated envelope structure presenting a sequence of clover-leaf cavities coupled together for the fundamental mode of operation; said envelope including a plurality of axially spaced, annular clover-leaf-defining wall sections and intervening coupling plates, all presenting a generally cylindrical shape; each clover-leaf-defining wall section having a series of circumferentially spaced pockets presenting, interiorally of the wall section, clover-leaf-defining noses projecting toward the axis of said cylindrical profile; and a plurality of permanent magnets, each filling a different pocket whereby said permanent magnets are contained at least substantially wholly within said cylindrical shape.

7. An improved travelling wave tube as defined in claim 6 wherein said clover-leaf-defining wall sections are made of copper hermetically joined to said coupling plates.

8. An improved travelling wave tube of the clover-leaf cavity type and employing periodic permanent magnet focussing, comprising in combination:

an evacuated envelope of generally cylindrical shape and consisting essentially of a series of annular, corrugated sheets and intervening coupling plates all hermetically joined to provide the side wall of the evacuated envelope, whereby each corrugated sheet defined in association with a pair of said coupling plates a series of circumferentially spaced, radially inwardly directed pockets which form a clover-leaf cavity internally of the envelope; and permanent magnet elements fitted into and filling said pockets to define periodic permanent magnet focussing structure contained substantially wholly within the confines of said cylindrical shape while at the same time being disposed exteriorally of said envelope.

* * * * *